United States Patent [19]

Covell et al.

[11] 4,302,890

[45] Dec. 1, 1981

[54] ANTI-SLIPPING ATTACHMENT FOR SHOES

[75] Inventors: John Covell, P.O. Box 472, Greenwood Lake, N.Y. 10925; Laurence Brulin, Ridgefield, Conn.

[73] Assignee: John Covell, Greenwood Lake, N.Y.

[21] Appl. No.: 168,298

[22] Filed: Jul. 14, 1980

[51] Int. Cl.[3] ..... A43B 3/10; A43C 15/00

[52] U.S. Cl. ..... 36/7.6; 36/62

[58] Field of Search ..... 36/7.6, 62, 64, 65, 36/66

[56] References Cited

U.S. PATENT DOCUMENTS

| | | | |
|---|---|---|---|
| 1,848,968 | 3/1932 | Ostrander | 36/7.6 |
| 2,399,638 | 5/1946 | Kalnitz | 36/7.6 |
| 2,876,563 | 3/1959 | Aitken | 36/62 |
| 3,834,045 | 9/1974 | Crigger et al. | 36/7.6 |

*Primary Examiner*—Patrick D. Lawson

*Attorney, Agent, or Firm*—Jack D. Slobod

[57] ABSTRACT

An anti-slipping attachment for shoes is disclosed in two embodiments, one for both the sole and heel and the other for the sole alone. The sole portion of each embodiment includes a pair of overlapped plates pivotted together at their rear ends permitting adjustment of the width of the device at its front end. One plate includes an integral tab bent over the other plate to serve as a guide and the other plate includes an integral stop which cooperates with the tab to limit the maximum angular displacement of the plates. The plates, which have integral teeth and integral apertured ears for receiving a strap, are each formed by bending from identical sheet metal blanks.

10 Claims, 6 Drawing Figures

ANTI-SLIPPING ATTACHMENT FOR SHOES

FIELD OF THE INVENTION

The present invention relates generally to anti-slipping devices adapted to be secured to the underside of a shoe or boot to facilitate ambulation on a slippery surface, such as ice. In its particular aspects, the present invention relates to an anti-slipping device in which a portion adapted to underlie the sole includes a pair of at least partially overlapped plates which are pivotted together at their rear ends to enable adjustment of the width of the front end of the device.

BACKGROUND OF THE INVENTION

While there have heretofore been suggested numerous adjustable ice creepers, anti-slipping devices and crampons for attachment to the underside of a shoe or boot within a range of sizes, each of these prior art devices have been complicated of construction and relatively expensive to manufacture. Furthermore, prior art devices in many cases, have been composed of an inordinate number of parts, have been excessively heavy, have been difficult to adjust and have not had sufficient strength to withstand the stresses experienced in the many applications of the devices.

OBJECTS OF THE INVENTION

It is an object of the present invention to provide a lightweight, inexpensive, easily manufactured, adjustable anti-slipping device adapted to be secured underlying a shoe or boot.

It is a further object of the present invention to provide an anti-slipping device which is composed of a minimal number of sheet metal parts which are produced from a minimal number of types of blanks.

It is yet another object of the present invention to provide an anti-slipping device having a sole portion in the nature of a pair of relatively rotatable overlapped plates, which plates include integral teeth, and integral guide and stop means for defining a maximum width of the front of the device.

SUMMARY OF THE INVENTION

Briefly, the aforementioned and other objects of the present invention are satisfied by providing an anti-slipping device including a portion adapted to be secured to the sole of a shoe or boot, which is formed by a pair of overlapped plates pivotted together at their rear ends for relative rotation along each other to permit adjustment of the degree of overlap of the plates and the resultant width of the front end of the device.

The pair of plates are formed from identical sheet metal blanks with downwardly directed integral teeth and an upwardly directed integral appertured ear for receiving a strap means being formed by perpendicularly bending portions of the blanks. Prior to bending, one of the blanks is turned over so that the resultant pair of plates are mirror images of each other.

In order to maintain the plates against each other an integral tab or guide means projecting from the front of one plate is bent in a U-shape about the other plate and the tab portions of the other plate is cut off. An integral stop portion on the other plate is bent perpendicularly for the purpose of contacting the tab and limiting further relative rotation of the plates at a position which is predetermined to be the maximum width of the front of the device.

The means which pivot together the pair of plates also retains a relatively small apertured member for receiving another strap means for engaging the ankle.

In an embodiment adapted to provide anti-slipping means for the heel as well as the sole, the ears of the pair of plates are secured to a U-shaped bail for encircling the rear of the shoe or boot and a second pair of relatively pivotted plates having integral teeth and integral ears are also secured to the invention will become apparent upon perusal of the following detailed description of the preferred embodiments thereof when taken in conjunction with the appended drawing.

DETAILED DESCRIPTION

Figure 1:
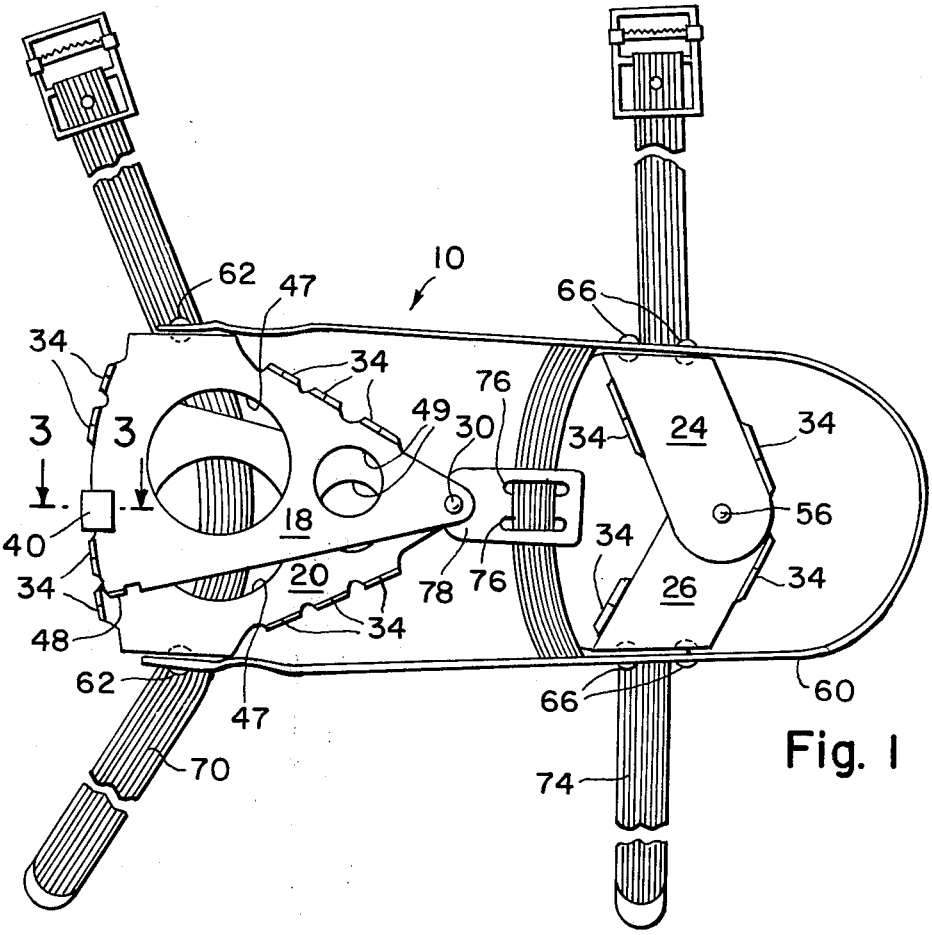
FIG. 1 is a bottom view of a first embodiment of the anti-slipping device of the present invention adapted to underlie the sole and heel of a shoe or boot.
Figure 2:
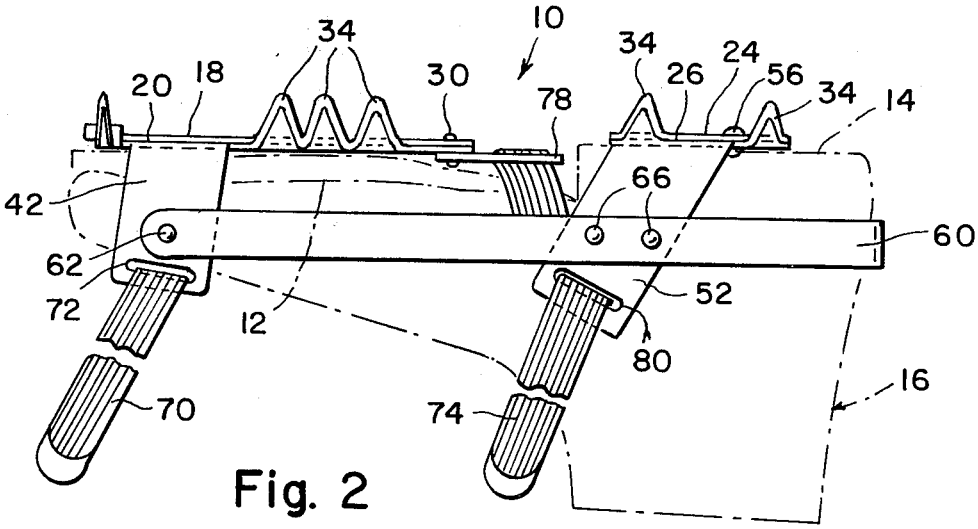
FIG. 2 is an upside down side view of the device in FIG. 1.
Figure 3:
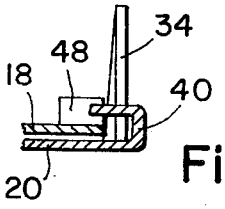
FIG. 3 is a cross section view taken on line 3—3 in FIG. 1.
Figure 4:
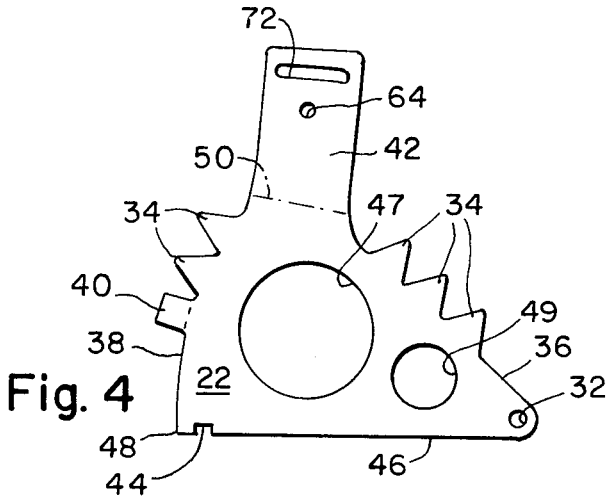
FIG. 4 is a plan view of a blank from which members at the front of the device in FIG. 1 are formed.
Figure 5:
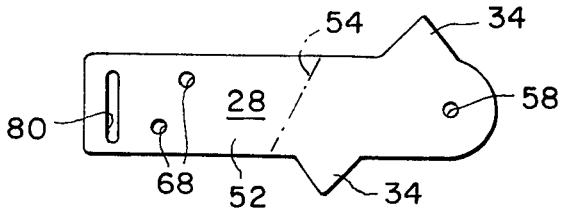
FIG. 5 is a plan view of a blank from which members at the rear of the device in FIG. 1 are formed.

A first embodiment 10 of the anti-slipping device of the present invention, adapted to underlie the sole 12 and heel 14 of a shoe or boot 16, is illustrated in FIGS. 1 through 3 of the drawing, and shall hereafter be referred to as the "full foot" design. Full foot design 10 includes a pair of generally sector-shaped sole plates 18 and 20, made from stampings or blanks 22 illustrated in FIG. 4 and a pair of heel plates 24 and 26, made from the stampings or blanks 28 illustrated in FIG. 5. The sole plates 18 and 20 and heel plates 24 and 26 are of preferably 15 gauge steel for reasonable lightness with adequate strength.

Sole plates 18 and 20 partially overlap each other and are secured by a rivet 30 which passes through a hole 32 proximate the apex of each sole plate. The fit of rivet 30 in holes 32 is such that each sole plate may be angularly moved about the rivet as an axis. Thus, the angle of overlap of the sole plates 18 and 20 may be changed to vary the width of the front of the full foot design 10 to facilitate accommodation of shoes or boots 16 of various sizes.

The blank 22 has triangular shaped integral teeth 34 projecting along one straight side 36 and along the one half of the arcuate side 38 which adjoins straight side 36. Further features of the blank 22 are a rectangular tab 40 projecting proximate the center of arcuate side 38, an integral rectangular ear 42 projecting from a point between straight side 36 and arcuate side 38, and a notch 44 in the other straight side 46 forming a small tab 48 between the notch and arcuate side 38. In addition, holes 47, 49 are provided in blank 22, for the purpose of recuding the weight of the sole plates 18, 20.

In the formation of sole plates 18 and 20 from an identical pair of blanks 22, one of the blanks is first turned over so that it is the mirror image of the other.

Then the teeth 34 of each blank 22 are bent perpendicularly in one direction and the ear 42 of each blank 22 is bent perpendicularly in the opposite direction along fold line 50. In the blanks for sole plate 18, tab 40 is cut off essentially flush with the arcuate side 38, while in the blank for sole plate 20, the tab 40 is bent in a U-shape about sole plate 20 which is underneath plate 18, as illustrated in FIG. 3, as a guide means to retain the plates 18 and 20 against each other while permitting relative angular movement of the plates. Furthermore, the small tab 48, only on the blank 22 for the sole plate 18, is bent perpendicularly in the same direction as teeth 34 as a stop for engaging the U-shaped tab 40 of plate 20 to define a minimum amount of angular overlap between plates 18 and 20, and consequently, a maximum width to which the front end of "full foot" design 10 may be adjusted.

The heel plates 24 and 26 are also constructed from identical blanks 28 in a similar manner. The blank 28 is generally in the shape of a strip having at least one tooth 34 projecting from each side. In the formation of heel plates 24, 26 one of the identical blanks 28 is first turned over. Then, for each blank 28, teeth 34 are bent perpendicularly in one direction and an ear 52 at one end is formed by bending perpendicularly in the opposite direction along the inclined fold line 54. Thereafter the heel plates are secured together by means of a rivet 56 through each hole 58 proximate the end of blank 28 opposite ear 52. The fit of rivet 56 in hole 58, is also such as to permit relative angular movement of heel plates 24, 26 about rivet 56 as an axis.

In the "full foot" design 10, a U-shaped flexible sheet metal bail 60 of preferably 16 gauge steel, is utilized to encircle the sides and rear of shoe or boot 16 and the ears 42 of sole plates 18 and 20 are each attached at the open end of bail 60 by means of rivets 62 through holes 64 provided in blank ears 52 of heel plates 24 and 26 are secured to the sides of bail 60 by means of pairs of rivets 66 through holes 68 in blank 28 and matching holes (not shown) in bail 60.

It should be appreciated that in the adjustment of "full foot" design 10, the sides of bail 60 flex toward or away from each other to permit the adjustment of relative angular overlap between sole plates 18 and 20, and consequent adjustment of the wideth of the front end of design 10. This flexing action of the bail 60 is aided by relative angular movement of heel plates 24, 26 about rivet 56.

The "full foot" design 10 is secured to the shoe or boot 16 by means of a front strap 70 which passes through slots 72 in the ears 42 of sole plates 18, 20 and is buckled over the toe portion, and a rear strap 74 which is buckled over the ankle portion of shoe or boot 16. Front strap 70, when buckled, serves to urge the sole plates 18 and 20 toward maximum overlap so that ears 42 contact the sides of shoe or boot 16 for a secure fit and binding of the sole plates against the sole of the shoe or boot. Rear strap 74 passes through a pair of parallel slots 76 in a small rearwardly directed plate 78 retained by rivet 30 to sole plates 18, 20 and through slots 80 in ears 52 of heel plates 24, 26. The small plate rearwardly directed plate 78 bends upward in response to tension in rear strap 74 to engage the shank of the sole of shoe or boot 16 for the purposes of aiding in preventing forward slippage of "full foot" design 10 relative to the shoe or boot. Furthermore, small plate 78, terminates just in front of heel 14 in manner that it serves as a stop for contacting the front of the heel to limit rearward slippage of "full foot" design 10.

Figure 6:
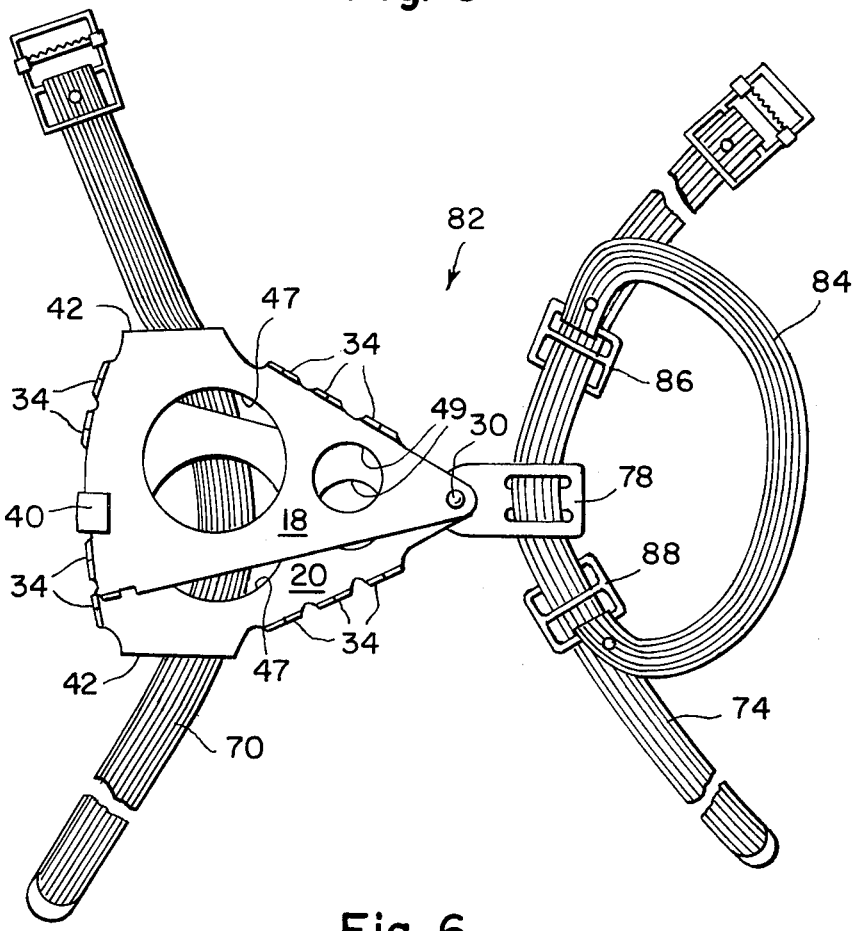
FIG. 6 is a bottom view, similar to FIG. 1, but of a second embodiment of the anti-slipping device of the present invention which is adapted to underlie the sole alone.

In FIG. 6, there is illustrated the "front foot" design 82 which consists of the same sole plates 18 and 20, small plate 78, rivet 30, front strap 70 and rear strap 74 as in the "full foot" design 10. In place of the bail 60 and heel plates 24, 26 of the "full foot" design 10, there is utilized a heel strap 84. Heel strap 84 is terminated at opposite ends with slider elements 86, 88 through which rear strap 74 pass respectively on opposite sides of small plate 78. Heel strap 84 is utilized by placing it about the back of shoe or boot 16 in approximately the same position that the rear of bail 60 would be located in the "full foot" design 10. The rear strap 84 is then engaged over the ankle portion of shoe or boot 16. As rear strap 74 is tensioned, heel strap 84 tightly engages the rear of shoe or boot 16.

It should be appreciated that while the preferred embodiments of the present invention have been described herein in specific and complete detail, numerous modifications in, additions to, and ommissions of said details are possible within the intended spirit and scope of the invention.

What is claimed is:

1. An anti-slipping device adapted to be fitted under the sole of a shoe, said device having a front end adapted to be positioned proximate the front end of said sole, said device comprising:

a pair of at least partially overlapped plates, each of said plates having a front end located at the front end of said device and a rear end;

means, proximate the rear ends of said plates, for pivotting together said plates for relative rotation along each other, enabling adjustment of the width spanned by the front ends of said plates;

integral teeth projecting generally perpendicularly downward from the peripheries of said plates;

one of said plates having integral guide means extending from its front end and about the other plate for maintaining the front ends of said plates against each other; and means carried by each of said plates for attaching said device to said shoe.

2. The device of claim 1 further comprising integral stop means projecting generally perpendicularly from said other plate for defining a maximum width of said device by engaging said guide means when said plates are relatively rotated such that the front ends of said plates span said maximum degree of width.

3. The device of claim 2 wherein said pair of plates comprises a left plate and a right plate and wherein said attaching means includes a left integral ear extending generally perpendicularly upward from the left side of said left plate and a right integral ear extending generally perpendicularly upward from the right side of said right plate.

4. The device of claim 3 wherein said left and right ears are apertured for receiving strap means.

5. The device of claim 4 further comprising an apertured member, secured to said pair of plates by said pivotting means, for receiving a second strap means.

6. The device of claim 3 wherein the aforementioned pair of plates comprise front plates which are adapted to be positioned forward of the heel of said shoe, said device further comprising a flexible U-shaped bail for extending about the sides and back of said shoe; means securing said ears to said bail; rear left and right partially overlapped plates adapted to be positioned under the heel of said shoe, said rear plates being pivotted together at their rear ends; rear integral teeth extending generally perpendicularly downward from the peripheries of said rear plates; a left rear integral ear extending generally perpendicularly upward from the left side of said left rear plate, a right rear integral ear extending generally perpendicularly upward from the right side of said right rear plate, and means securing said left and right rear ears of said bail.

7. The device of claim 6 wherein said left and right ears extending from said front plates are apertured for receiving a first strap means and said left and right rear ears extending from said rear plates are apertured for receiving a second strap means.

8. The device of claim 7 further comprising an apertured member, secured to said front pair of plates by said pivotting means for also receiving said second strap means.

9. The device of claim 3 wherein said left and right plates are each formed from identical plates having said teeth, ears, guide means, and strap means extending within the planes of said identical plates, by bending the teeth and ears in opposite directions for the left plate than for the right plate, by bending said guide means for one of said left and right plates, and by bending the strap means for the other of said left and right plates.

10. The device of claim 8 wherein said apertured member extends rearwardly from said pivotting means and comprises means for engaging the heel of said shoe to prevent rearward slippage of said device relative to said shoe.

* * * * *